US006959279B1

(12) United States Patent
Jackson et al.

(10) Patent No.: US 6,959,279 B1
(45) Date of Patent: Oct. 25, 2005

(54) TEXT-TO-SPEECH CONVERSION SYSTEM ON AN INTEGRATED CIRCUIT

(75) Inventors: Geoffrey Bruce Jackson, Mountain View, CA (US); Aditya Raina, San Jose, CA (US); Bo-Hung Wu, Saratoga, CA (US); Chuan-Shin Rick Lin, Milpitas, CA (US); Ming-Bing Chang, Los Altos Hills, CA (US); Bor-Wen Yang, San Jose, CA (US); Wen-Kuei Chen, Sunnyvale, CA (US); Peter J. Holzmann, San Jose, CA (US); Rodney Lee Doan, Alviso, CA (US); Saleel V. Awsare, Redwood City, CA (US)

(73) Assignee: Winbond Electronics Corporation, (TW)

( * ) Notice: Subject to any disclaimer, the term of this patent is extended or adjusted under 35 U.S.C. 154(b) by 448 days.

(21) Appl. No.: 10/108,766

(22) Filed: Mar. 26, 2002

(51) Int. Cl.[7] ..... G10L 13/00; G10L 13/04

(52) U.S. Cl. ..... 704/258; 704/260; 365/45

(58) Field of Search ..... 704/258, 260, 704/266, 267, 268, 269; 365/45; 369/63, 369/64

(56) References Cited

U.S. PATENT DOCUMENTS

| | | | | |
|---|---|---|---|---|
| 4,653,100 | A * | 3/1987 | Barnett et al. | 704/268 |
| 4,890,259 | A * | 12/1989 | Simko | 365/185.03 |
| 5,634,084 | A * | 5/1997 | Malsheen et al. | 704/260 |
| 5,636,325 | A * | 6/1997 | Farrett | 704/258 |
| 5,890,115 | A * | 3/1999 | Cole | 704/258 |
| 6,317,036 | B1 * | 11/2001 | Popat et al. | 340/432 |
| 6,347,136 | B1 * | 2/2002 | Horan | 379/142.01 |
| 6,701,295 | B2 * | 3/2004 | Beutnagel et al. | 704/258 |

* cited by examiner

*Primary Examiner*—Martin Lerner
(74) *Attorney, Agent, or Firm*—Dinh & Associates

(57) ABSTRACT

A text-to-speech conversion system that includes a first module to convert text into words, a second module to convert words into phonemes, a third module to map phonemes to sound units, and a storage unit to store speech representations for a library of sound units. The first, second, and third modules and the storage unit are implemented within a single integrated circuit to reduce size and cost. The system typically further includes a ROM to store the codes for the modules, a RAM to store the text and intermediate results, a processor to execute the codes for the modules, a control module to direct the operation of the first, second, and third modules. The storage unit may be implemented with a multi-level, non-volatile analog storage array and may be programmed with a new library of speech representations by a programming module.

24 Claims, 4 Drawing Sheets

TEXT-TO-SPEECH CONVERSION SYSTEM ON AN INTEGRATED CIRCUIT

BACKGROUND OF THE INVENTION

The present invention relates generally to integrated circuits, and more specifically to a text-to-speech conversion system on a single integrated circuit.

The conversion of text into speech has become increasingly important with the emergence of data communication and other new applications. Most data is stored and provided in a digital format that can be more easily processed and manipulated by digital processing means. The digital data may need to be converted to an analog format for speech that is intelligible to humans. Text-to-speech conversion is a process whereby data in a particular digital format (e.g., ASCII text) is converted into a particular analog format (e.g., speech) suitable for reception by humans.

Many conventional text-to-speech conversion systems are based on a pure software implementation that requires (1) a powerful processor to perform various computation and translation tasks, (2) a large memory to store an inventory of speech sounds, and (3) possibly other peripherals such as sound cards. For example, U.S. Pat. No. 5,878,393 describes a "high quality concatenated reading" system comprised of a central processing unit (CPU), a random access memory (RAM), a disk storage system, a sound card, and so on. This system is suitable for implementation on a personal computer (PC) system having all of these required hardware elements. Other text-to-speech conversion systems, such as those described in U.S. Pat. Nos. 5,634,084 and 5,636,325, are also based on the use of PC systems.

PC-based text-to-speech conversion systems such as those identified above are not well suited for many modern-day applications where processing power may be limited and device size may be a major design consideration. Such applications may include, for example, portable devices (e.g., personal digital assistance or PDA), mobile communication devices (e.g., cellular phones, pagers), consumer electronics, and so on. For these applications, size, cost, and power consumption may all be important design considerations that would preclude the use of conventional pure software-based text-to-speech conversion systems.

As can be seen, a text-to-speech conversion system that can be used for a wide variety of applications, such as those listed above, is highly desirable.

SUMMARY OF THE INVENTION

The invention provides a text-to-speech conversion system implemented on a single integrated circuit (IC). The inventive system incorporates various elements needed to perform the text-to-speech conversion process, which conventionally have been implemented using multiple independent elements. The inventive text-to-speech conversion system may thus be advantageously employed in various applications where size, cost, and/or power consumption are important design considerations.

A specific embodiment of the invention provides a text-to-speech conversion system that includes a first module operative to convert text (which may be in ASCII format) into pronounceable words, a second module operative to convert the pronounceable words into phonetic representations (e.g., phonemes), a third module operative to map the phonetic representations to sound units, and a storage unit operative to store speech representations for a library of sound units. Each sound unit may cover a sub-word, a word, a syllable, or a phoneme and is represented by a corresponding speech or sound representation in the storage unit. The first, second, and third modules and the storage unit are implemented within a single integrated circuit to reduce size and cost.

The first, second, and third modules may each be implemented with software. In this case, the system includes a read-only memory (ROM) to store the codes for the first, second, and third modules, a random-access memory (RAM) to store the text to be converted to speech and intermediate results, and a processor to execute the codes for the first, second, and third modules. The system typically further includes a control module to direct the operation of the first, second, and third modules.

The storage unit may be implemented with a multi-level, non-volatile analog storage array (or a digital memory) and stores a library of (e.g., four million or more) speech representations. A programming module may be used to program the storage unit with a new library of speech representations.

The system may further include a number of queues, one queue for each of the first, second, and third modules, which are used to facilitate communication between these modules. Each queue stores the outputs from the associated module. The system may further include an input data buffer to store the text to be converted to speech and a command buffer to store the commands to be processed by the system. These queues and buffers may be implemented in the RAM. The system may further include an interface unit to provide a serial interface between the system and other external units and a coder/decoder (CODEC) to convert the output of the storage unit into a digital format.

Another specific embodiment of the invention provides an integrated circuit that includes a volatile storage unit (e.g., a random-access memory (RAM)) used to store text, a non-volatile storage unit (e.g., a read-only memory (ROM)) used to store codes for a number of (e.g., software) modules used to convert the text to speech, a processor capable of executing the codes for the modules, and a storage unit to store a library of speech representations. Again, the modules may include a first module operative to convert the text into pronounceable words, a second module operative to convert the pronounceable words into phonetic representations, and a third module operative to map the phonetic representations to sound units. The integrated circuit may further include a serial interface unit to provide an interface between the integrated circuit and other external units and a programming control unit to direct programming of a new library of speech representations into the storage unit.

Various other aspects, embodiments, and features of the invention are also provided, as described in further detail below.

The foregoing, together with other aspects of this invention, will become more apparent when referring to the following specification, claims, and accompanying drawings.

DESCRIPTION OF THE SPECIFIC EMBODIMENTS

Figure 1:
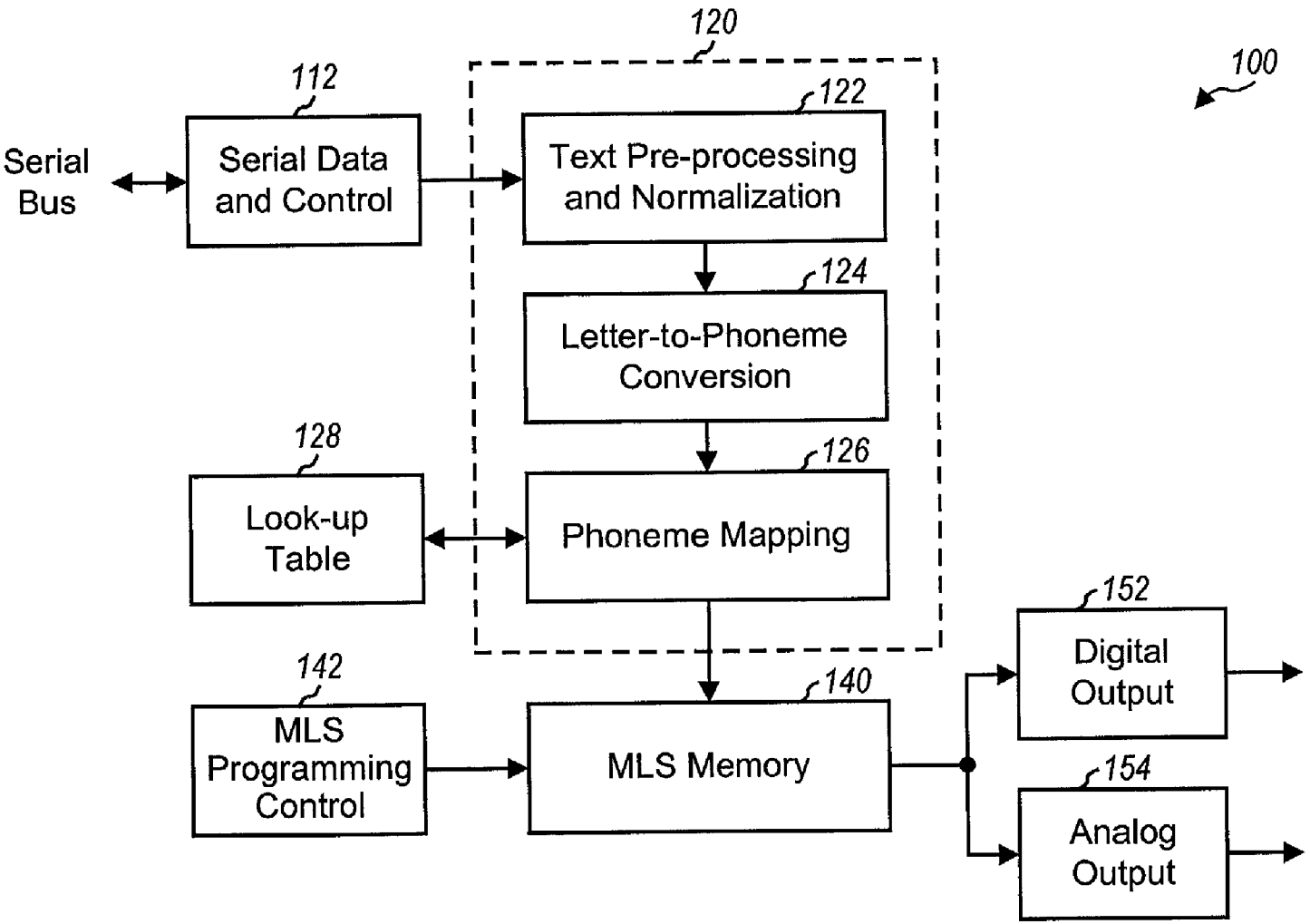
FIG. 1 is a block diagram illustrating the functional modules for a text-to-speech conversion system, in accordance with an embodiment of the invention.

FIG. 1 is a block diagram illustrating the functional modules for a text-to-speech conversion system 100, in accordance with an embodiment of the invention. System 100 performs text-to-speech synthesis by converting input text into units of speech and then concatenating these speech units. In general, the units for concatenation may be whole words, syllables, phonemes, or some other units. A word is a unit of expression comprised of one or more spoken sounds, a syllable is an uninterrupted segment of speech, and a phoneme is the minimum unit of speech sound that can serve to distinguish one word from another. For example, the word "twenty" may be decomposed into two syllables, "twen" and "ty", and the syllable "twen" may further be decomposed into two phonemes "t" and "wen".

In general, synthesizing the output speech with increasingly larger speech units can result in increasingly higher output speech quality. The text-to-speech conversion system described herein may be used with any unit of concatenation. However, for clarity, various aspects and embodiments of the invention are described for a specific design whereby the unit of concatenation is "sub-words", each of which comprises one or more phonemes.

In system 100, a serial data and control module 112 provides an interface to other external units and devices via an input/output (I/O) port. To minimize pin count, this I/O port may be a serial peripheral interface (SPI) port, although some other types of I/O port may also be used and are within the scope of the invention. Module 112 monitors the serial port, receives commands and data via the port, and interprets and forwards the received commands and data to the proper destinations within system 100. The commands instruct system 100 to perform various functions, and the data may be the text to be converted to speech. The data may be provided in various digital formats such as, for example, ASCII text, Unicode, or some other representation.

A text pre-processing and normalization module 122 pre-processes incoming text received from module 112 and converts it into "pronounceable" words, which are phonetic representations for the received text. A letter-to-phoneme conversion module 124 then receives and converts the words from module 122 into phonemes. The word-to-phoneme mapping may be performed in accordance with a set of linguistic rules. Although not shown in FIG. 1, a text-to-phoneme translator may also be used to receive and convert the incoming text directly into phonemes, and this is within the scope of the invention.

A phoneme mapping module 126 then receives and maps the phonemes from module 124 into valid sub-words, words, phonemes, and/or syllables. In an embodiment, these valid sub-words/words/phonemes/syllables are naturally spoken word parts that are stored in a corpus of "sound units". The corpus stores complete whole words that may be long or short, such as "I", "am", "book", or "com". Module 126 thus takes the phonetic representation and matches them to the closest sound in the corpus. The closest sound could be whole word such as "am" or part of word such as "com" in "communicate". The corpus of sound units may be tailored to a specific application, a specific language (e.g., English, Chinese, Italian, and so on), or some specific requirements.

A multiple level storage (MLS) memory 140 stores speech representations for the corpus (i.e., a library) of pre-recorded sound units, which can be divided or used wholly as valid sub-words with which the output speech may be produced. The phoneme mapping is performed based on a lookup table (LUT) 128 that stores a mapping of the various sound units. In an embodiment, module 126 provides a start address and the duration of the speech representations in the MLS memory for the sound units. Each set of start address and duration identifies a specific speech representation stored in MLS memory 140. The concatenation of phonemes to produce words is thus effectively achieved by sending to MLS memory 140 a series of start address and duration for the mapped speech representations and their durations.

The number of speech representations to be stored in MLS memory 140 is dependent on various considerations such as die size, cost, complexity, and so on. In an embodiment, MLS memory 140 is designed with the capacity of four or more million bits (e.g., six million bits), with one or more bits being used to store each speech representation for one sound unit. For each set of start and stop addresses, MLS memory 140 provides an analog speech representation corresponding to the sound unit identified by the addresses. Each speech representation is also provided for a length of time determined by the indicated duration.

In an embodiment, MLS memory 140 stores the speech representations for the valid sub-words/words/phonemes/syllables in an uncompressed format using a multi-level, non-volatile analog storage array. A specific design of such an analog storage array is described in detail in U.S. Pat. No. 6,282,119, entitled "Mixed Program and Sense Architecture Using Dual-Step Voltage Scheme in Multi-Level Data Storage in Flash Memories," issued Aug. 28, 2001, and U.S. patent application Ser. No. 4,989,179, entitled "High Density Integrated Circuit Analog Signal and Playback System," filed Dec. 26, 1989, which is incorporated herein by reference. Storage of the speech representations in an uncompressed analog format can result in improved sound quality, since quantization noise and other artifacts may be eliminated or reduced. However, the speech representations may also be stored based on some other memory designs, and this is within the scope of the invention.

In an embodiment, the corpus of sound units stored in MLS memory 140 may be programmed as desired or necessary. A programming control module 142 provides the controls and data needed to program MLS memory 140. The command to initiate the programming of the MLS memory and the new corpus of sound units may be provided via the serial port. This then allows different languages and speaker databases to be easily downloaded onto the MLS memory for different applications.

A digital output module 152 and an analog output module 154 receive and condition the output from MLS memory 140 and provide digital and analog outputs, respectively. The output from digital output module 152 may be provided to other digital units and devices, and the output from analog output module 154 may be provided to other units, devices, or elements (e.g., speakers).

In an embodiment, the unit of concatenation is sub-words. However, the text-to-speech conversion may also be implemented using other units of concatenation such as, for example, word, syllable, or phoneme. For these alternative implementations, lookup table 128 may be designed to store the proper mapping and MLS memory 140 may be designed to store the speech representation for the selected unit of concatenation.

Text-to-speech conversion system 100 may be advantageously implemented with a combination of hardware and software. In a specific embodiment, the software system performs (1) the overall control functions for system 100 and (2) the processing of incoming text into a sequence of valid sub-words. For this embodiment, text pre-processing and normalization module 122, letter-to-phoneme conversion module 124, and phoneme mapping module 126 within block 120 in FIG. 1 are each implemented with software codes that can be executed by a processor. The remaining functional modules in FIG. 1 may be implemented with hardware and/or software, as described below.

In an alternative embodiment, some or all of the processing to convert text into speech may be performed by dedicated hardware. For example, text pre-processing and normalization module 122, letter-to-phoneme conversion module 124, and phoneme mapping module 126 in FIG. 1 may each be implemented with a respective hardware module.

Other designs that partition the text-to-speech conversion processing into different functional modules may be contemplated, and this is within the scope of the invention. Moreover, different software/hardware implementations for these functional units may be possible, and this is also within the scope of the invention.

Figure 2:
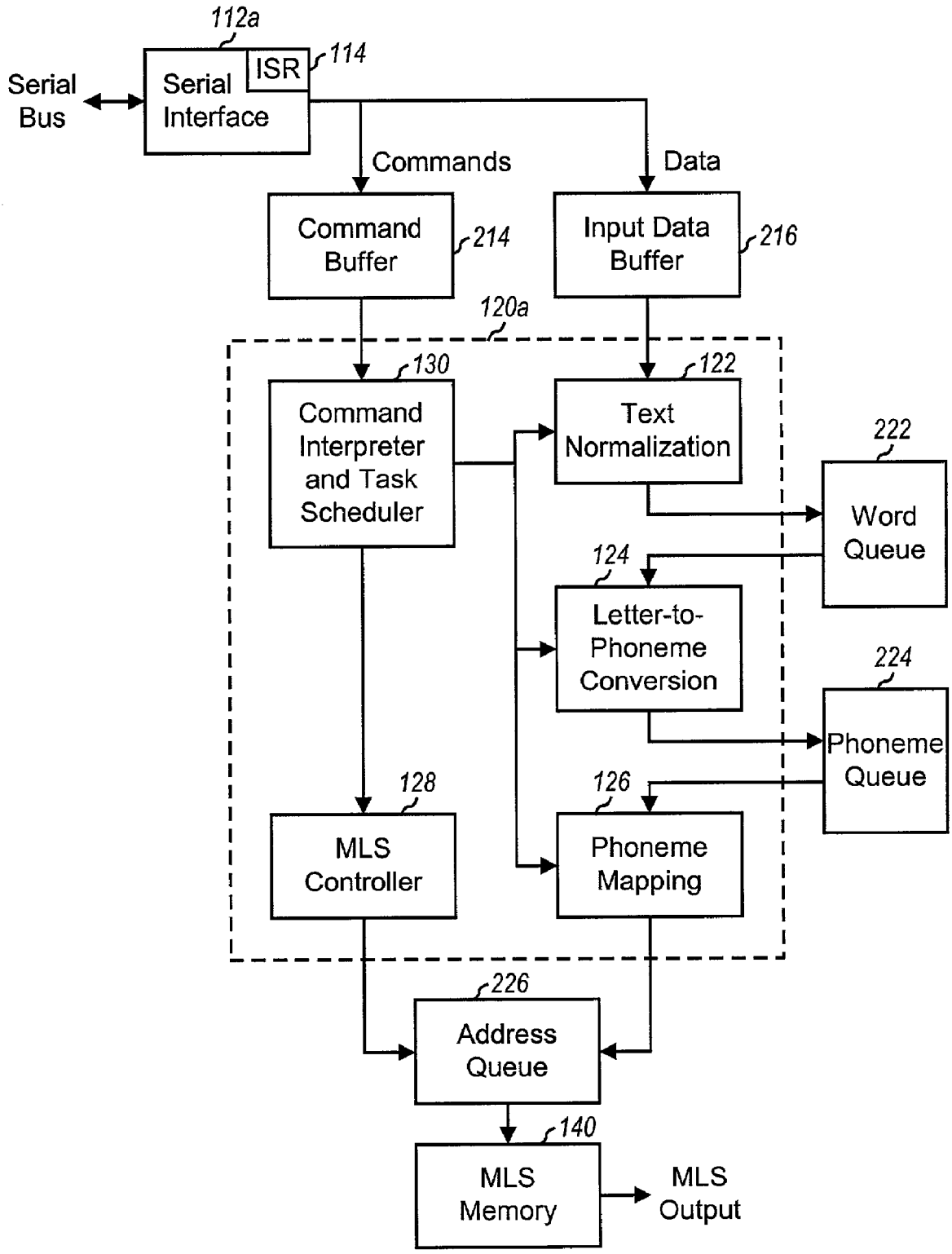
FIG. 2 is a block diagram of a specific embodiment of various software modules used within the text-to-speech conversion system shown in FIG. 1.

FIG. 2 is a block diagram of a specific embodiment of various software modules used within text-to-speech conversion system 100. A serial interface module 112*a* (which may be part of module 112 in FIG. 1) manages the communication between system 100 and external units and devices via the serial port. In an embodiment, module 112*a* includes a serial interrupt service routine (ISR) 114 that is triggered whenever a communication is received via the serial port. Serial ISR 114 then wakes up system 100, performs the necessary initializations, and further processes the received communication.

The received communication may include commands, data (e.g., text), or a combination of both. Serial ISR 114 extracts the commands from the received communication and provides these commands to a command buffer 214. If data is associated with the commands, then serial ISR 114 provides the received data to an input data buffer 216.

A command interpreter and task scheduler 130 performs the high-level functions of system 100 and further oversees the operation of other modules. Command interpreter 130 processes each command stored in buffer 214 until either (1) it is stopped or paused, or (2) all commands have been processed. Command interpreter and task scheduler 130 further controls the order in which other text-to-speech functional modules are called to process the received data.

In an embodiment, the text-to-speech conversion is performed by three functional modules—text normalization module 122, letter-to-phoneme conversion module 124, and phoneme mapping module 126. In an embodiment, the communication between these modules is achieved via queues implemented in a random access memory (RAM) within system 100.

Text normalization module 122 retrieves the input text (e.g., the ASCII text) stored in input data buffer 216, one word at a time, and processes each input text into one or more pronounceable words. In an embodiment, module 122 expands numbers and abbreviations into their pronounceable word equivalence. For example, an input word of "23" may be processed to generate the pronounceable words "twenty three". Because of expansion, the number of pronounceable words generated by module 122 can exceed the number of input words. Module 122 then provides the generated words to a word queue 222 for temporary storage. Module 122 further clears the input data buffer of the words that have been retrieved and processed, updates the head pointer for the word queue (which indicates where to store the next generated word), and provides an indication when the word queue has been loaded or the input word has been fully expanded.

Letter-to-phoneme conversion module 124 retrieves the words stored in word queue 222, one word at a time, and converts each word into a string of one or more phonemes. The word-to-phoneme conversion is performed based on linguistic rules. Module 124 then provides the generated phonemes to a phoneme queue 224 for temporary storage. Module 124 further clears the word queue of the words that have been converted by advancing the tail pointer for the word queue (which indicates where to retrieve the next word), advances the head pointer for the phoneme queue (which indicates where to store the next phoneme), and further provides an indication when the phoneme queue has been loaded or the retrieved word has been converted. Module 124 continues the word-to-phoneme conversion process until the word queue is empty or the phoneme queue is full, at which point the conversion process stops or pauses.

Phoneme mapping module 126 reads a string of phonemes from phoneme queue 224 and performs a mapping of the phoneme string into speech representations stored in MLS memory 140. Module 126 reads multiple phoneme units and maps them to the speech representations for the largest appropriate valid sub-word blocks in MLS memory 140. Module 126 then provides to an address queue 226 the addresses where each mapped speech representation is to be found in MLS memory 140 and the duration for which the speech representation should be played. Module 126 further provides a value indicative of the number of sets of addresses/duration provided to the address queue, advances the tail pointer for the phoneme queue as phonemes are read, and further advances the head pointer for the address queue as each set of addresses/duration is stored to the address queue. Module 126 continues the phoneme mapping process until the phoneme queue is empty or the address queue is full, at which point the mapping process stops or pauses. Since multiple phoneme units may be mapped to a single sub-word block, the output dimensionality may be much less than the input dimensionality for this module.

An MLS control module 128 retrieves the addresses and their associated durations from address queue 226 in real-time as they are needed unless the queue is empty. MLS control module 128 then generates timing controls based on the duration associated with each set of retrieved addresses. The retrieved addresses and timing controls are provided to MLS memory 140, which in response provides the analog speech representation for each speech unit identified by the received addresses. MLS control module 128 further monitors the address queue, which is operated as a first-in first-out (FIFO) buffer from this module's perspective, and updates the tail pointer for the address queue as each set of addresses/duration is retrieved.

In an embodiment, the commands that may be processed by system 100 includes:

Convert—a command indicating that the ASCII text sent along with this command is to be converted to speech.

Hold—a command to temporarily pause the text-to-speech conversion process.

Continue—a command to remove the pause and restart the text-to-speech conversion process.

Cancel—a command to immediately stop the text-to-speech conversion process without finishing up the conversion of the content in the input data buffer.

Finish—a command indicating the end of the ASCII text to be converted and to stop the conversion after processing the current buffer contents.

Finish Word—a command indicating that the conversion is to end with the processing of the current word.

Pause—a command indicating the end of the ASCII text to be converted, similar to the Finish command, but that the system should expect more ASCII text to follow subsequently.

Review—a command directing a back-up of a particular number of words.

Configure—a configuration command to set volume and path.

Get Version—a command to get version details of system 100, the software, and the corpus stored in MLS memory 140.

Update Program—a command to load new or revised software into the code memory.

Update MLS Memory—a command to start loading a new corpus of sound units into the MLS memory.

The exemplary list of commands described above is provided for illustration. Fewer, more, or different commands may also be supported by system 100, and this is within the scope of the invention. Some of the above commands are described in further detail below.

A Convert command starts the text-to-speech conversion process. The Convert command is followed by the (ASCII) text data to be converted to speech. In an embodiment, input data buffer 216 is implemented with a limited size (e.g., 256 bytes). When this buffer is full, a Ready/Busy line is pulled to logic low and a BFUL bit in an SPI status register is set to logic high to indicate the buffer-full condition. The buffer-full condition is maintained until the input data buffer has been emptied by a particular amount (e.g., half the buffer space, or 128 bytes for the above example).

In an embodiment, if the input data buffer is full, then the Host unit (i.e., the unit providing the commands and data to system 100) may perform one of several actions. First, the Host can terminate the Convert command at this point. Thereafter, the Host can poll the BFUL bit of the SPI status register until it is clear, at which point it can send a new Convert command with the additional ASCII text data. Second, the Host can continue the Convert command (keep SSB low) and wait for the Ready/Busy line to transition to logic high. As each word is processed by system 100, space becomes available in the input data buffer and the Ready/Busy line will remain at logic high until the buffer is full again.

System 100 may also be configured such that it generates an interrupt to the Host when a particular buffer threshold (which may be set by another command) has been crossed. This allows the Host to fill the input data buffer and then wait for the interrupt from system 100 before sending additional data.

During the text-to-speech conversion, a Convert Count Register is updated as each word is retrieved and synthesized (or "spoken"). This register is cleared to zero at power up and also at the beginning of a new text-to-speech conversion process after the prior one has been properly terminated.

A Convert command can be terminated in several ways. First, the Host can send a Finish command indicating that it has finished sending data. In this case, system 100 finishes converting the text stored in the input data buffer, then stops and enters a Wait state. Second, the conversion process also stops when an EOT character (which is "^D" or an ASCII value of 0x1A) is part of the input text. When system 100 detects the EOT character, it continues the conversion process until the input data buffer is emptied and the final word is synthesized, at which time it stops and enters the Wait state. Third, a Finish Word command can be issued to cause system 100 to finish the word currently being synthesized, then flush the input data buffer and enter the Wait state. And fourth, a Cancel command can be issued to cause system 100 to immediately stop the text-to-speech conversion process, flush the input data buffer, and enter the Wait state.

Upon entering the Wait state, system 100 clears a convert (CONV) bit from the SPI status register and, if enabled, generates a convert (ICVT) interrupt. At this point, the CODEC and analog path are still active. An Idle command may be sent to system 100 to release the CODEC bus or power down the analog path.

Figure 3:
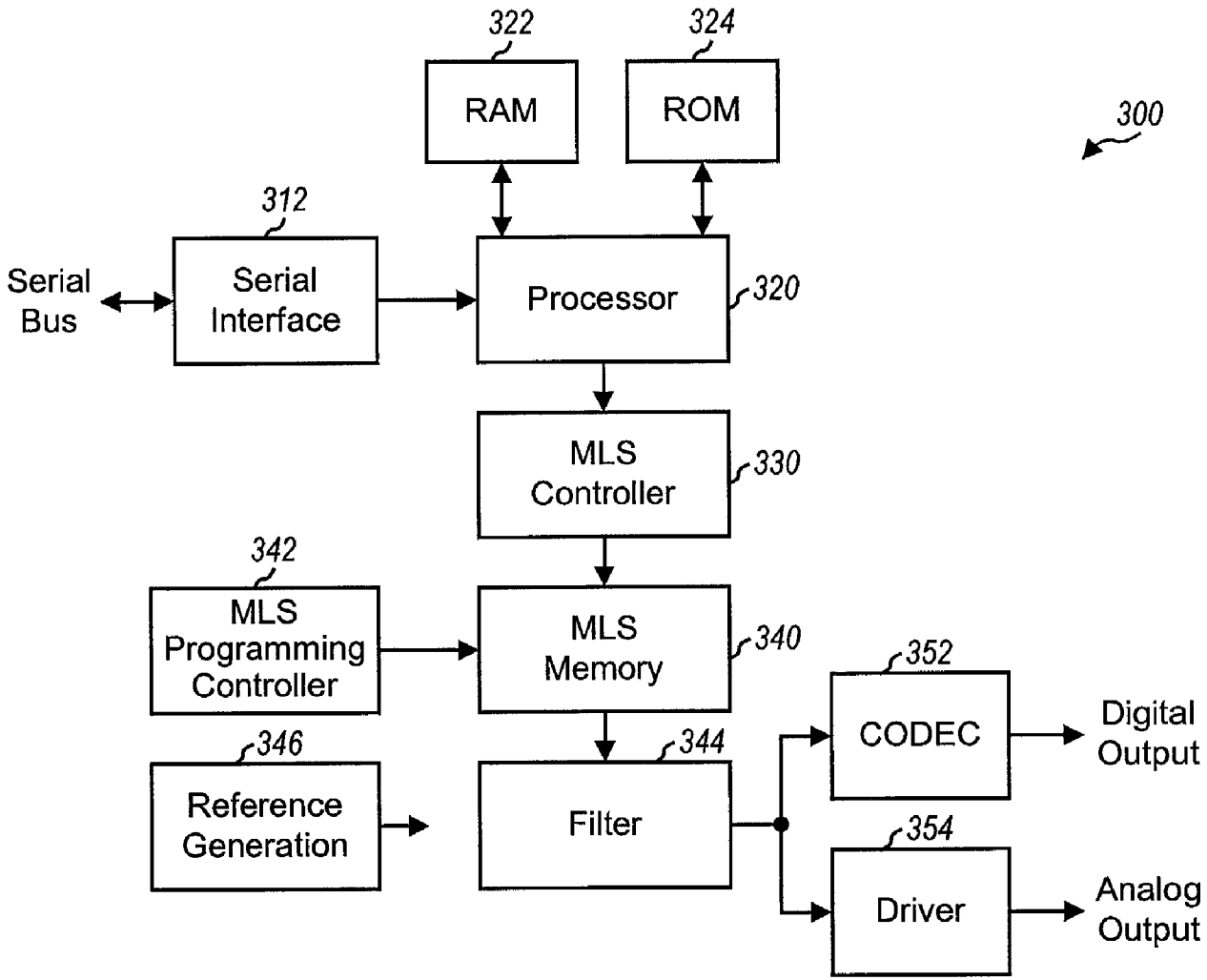
FIG. 3 is a block diagram of an embodiment of a hardware system that may be used to implement the text-to-speech conversion system shown in FIG. 1.

FIG. 3 is a block diagram of an embodiment of a hardware system 300 that may be used to implement text-to-speech conversion system 100. Within system 300, a serial interface unit 312 provides I/O interface for system 300 via a serial port. Serial interface unit 312 can implement serial data and control module 112 shown in FIG. 1.

A processor 320 couples to serial interface unit 312 and communicates with external units and devices via the serial interface unit. Processor 320 further couples to a RAM 322, a read-only memory (ROM) 324, and a MLS controller 330. RAM 322 may be used to store various types of data used by processor 320. For example, RAM 322 may be used to implement command buffer 214, input data buffer 216, word queue 222, phoneme queue 224, and address queue 226 shown in FIG. 2 and lookup table 128 shown in FIG. 1. ROM 324 may be used to store program codes and other data needed by processor 320. For example, ROM 324 may be used to store program codes for text normalization module 122, letter-to-phoneme conversion module 124, phoneme mapping module 126, and command interpreter and task scheduler 130 shown in FIG. 2.

RAM 322 may be implemented with dynamic RAM (DRAM), static RAM (SRAM), Flash, or some other RAM technology. ROM 324 may be implemented with Flash electronically erasable programmable ROM (EEPROM), one time programmable (OTP) ROM, mask ROM, or some other ROM technology.

Processor 320 executes the codes for various modules stored in ROM 324 and operates on various types of data stored in RAM 322. Processor 320 performs the overall control function for system 300 and further performs much of the processing to implement the text-to-speech conversion.

MLS controller 330 interfaces with processor 320 and further controls MLS memory 340. MLS controller 330 implements MLS control module 128 in FIG. 2, receives commands and addresses/duration from processor 320, and provides the addresses and timing controls to a MLS memory 340.

MLS memory 340 provides speech representations for the received addresses. The output from MLS memory 340 is filtered by a filter 344 to remove noise and smooth out discontinuities in the output signal, which are generated as a result of concatenating a series of waveforms for a series of speech representations. A coder/decoder (CODEC) 352 receives and further processes the filtered output to provide the speech output in a digital format, which is more suitable for other digital signal processing units. A driver 354 also receives and conditions the filtered output to provide the speech output in an analog format, which is more suitable for speakers and other components.

An MLS programming controller 342 interfaces with MLS memory 340 and directs the programming of MLS memory 340. MLS programming controller 342 implements MLS programming control module 142 in FIG. 1. MLS programming controller 342 receives instructions to program MLS memory 340, and these instructions may be generated by processor 320 based on a received "Update MLS memory" command. MLS programming controller 342 may also couple directly to serial interface unit 312 and/or processor 320 to receive the new corpus of sound units to be programmed into MLS memory 340. MLS programming controller 342 then prepares MLS memory 340 for programming and further performs various functions needed to program the speech representations for the new corpus of sound units into the MLS memory.

A reference generation unit 346 generates various reference voltages and signals needed by various units within system 300, including the references for MLS operations.

In the embodiment shown in FIG. 3, specialized units are designed to implement serial interface unit 312, MLS controller 330, MLS programming controller 342, and CODEC 352. Each of these specialized units may be implemented with logic, registers, and so on, as is known in the art.

Figure 4:
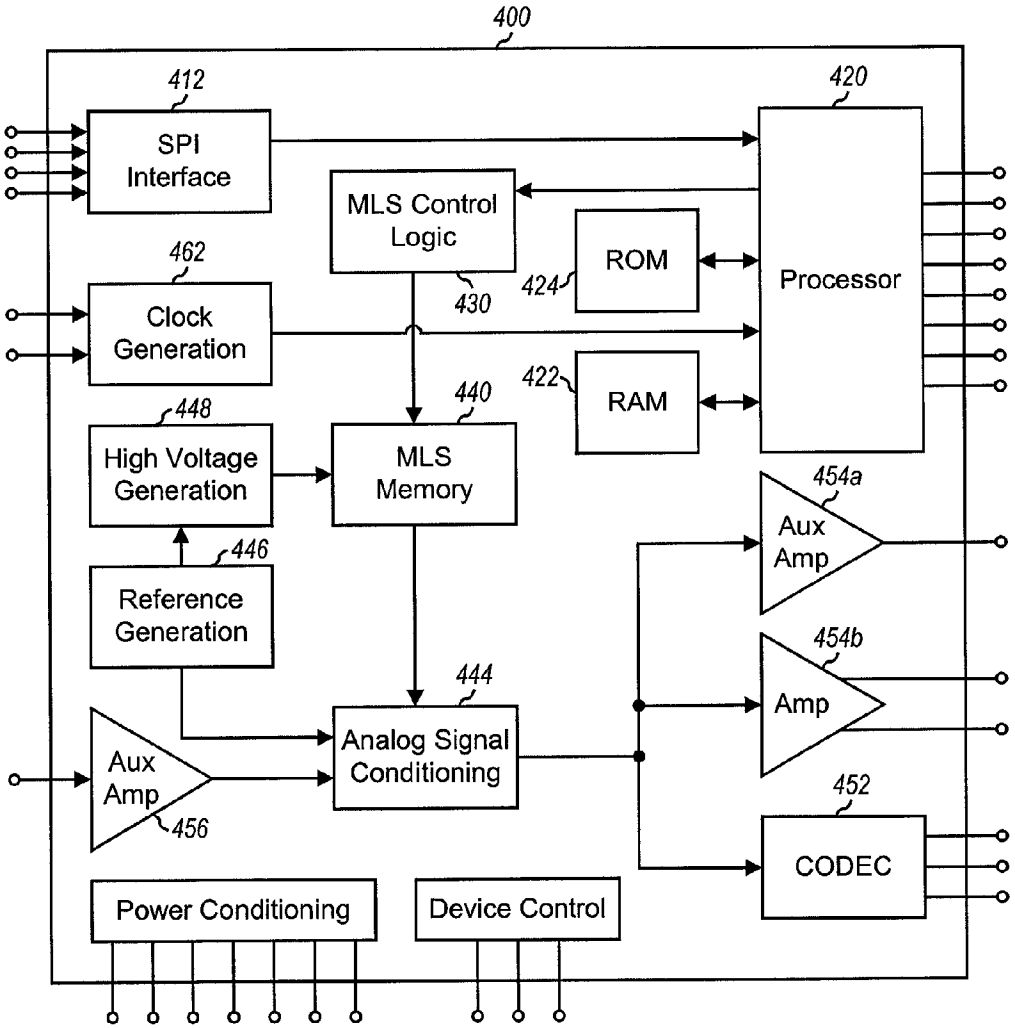
FIG. 4 is a block diagram of a specific design of an integrated circuit (IC) capable of implementing the text-to-speech conversion system shown in FIG. 1.

FIG. 4 is a block diagram of a specific design of an integrated circuit (IC) 400 capable of implementing text-to-speech conversion system 100, in accordance with an embodiment of the invention. Within IC 400, a serial peripheral interface (SPI) unit 412 controls the communication between IC 400 and external units and devices and further interprets the received commands and data. A processor 420 performs various system control functions and also processes the incoming text to generate the speech output.

A RAM 422 stores the various types of data operated on by processor 420 (e.g., the incoming text, the translated pronounceable words, the mapped phonemes, and the addresses and duration for the speech representations). A ROM 424 stores the program codes and other pertinent data needed by processor 420.

An MLS control logic module 430 interfaces with processor 420 and controls various operations of an MLS memory 440. During normal operation, MLS control logic module 430 provides the addresses and duration for the speech representations used to generate the output speech. And during programming operation, MLS control logic module 430 provides the necessary controls to program MLS memory 440 with a new corpus of sound units.

MLS memory 440 stores speech representations for the corpus of sound units in uncompressed form using a multi-level analog storage array. The output from MLS memory 440 is provided to an analog signal conditioning module 444 that performs filtering to remove noise, signal conditioning to obtain the proper signal amplitude, and so on. The filtered signal from module 444 is provided to buffers 454*a* and 454*b*, each of which buffers the received signal and provides the necessary signal drive for a respective output component (e.g., a speaker). The filtered signal from module 444 is also provided to a (e.g., 13-bit) CODEC 452 that converts the received signal, which is provided in an analog format, into a digital format (e.g., a linear, two's-complement format).

An auxiliary (AUX) amplifier 456 receives and amplifies an auxiliary input signal, and provides the amplified signal to module 444. The auxiliary input may be used to record waveforms into the MLS memory. This input may usually used for testing the MLS memory and for other purposes.

A high voltage generation module 448 generates the necessary high voltages for Flash operation of MLS memory 440. A reference generation module 446 generates the necessary voltage references needed by modules 444 and 448. A clock generation module 462 generates the clocks needed by various modules within IC 400.

The specific design shown in FIG. 4 provides various advantages including (1) single-chip text-to-speech conversion, (2) digital and analog speech outputs, (3) simple SPI interface, (4) power-down of individual modules, (5) ease of programmability for both the program codes and the corpus of sound units, and other benefits.

In the specific embodiments described above, a multi-level storage (MLS) memory is used to store speech representations for a corpus of sound units using an uncompressed format in a multi-level, non-volatile analog storage array. The use of an MLS storage array for the corpus of sound units may allow the text-to-speech conversion system to be implemented within a smaller die size, which may then reduce cost and power consumption.

The corpus of sound units may also be stored in some other storage units that are based on some other memory designs, and this is within the scope of the invention. For example, a conventional RAM or Flash may be used to store the speech representations for the corpus of sound units, with each speech representation being stored in a digital format (e.g., two's complement). Higher resolution for the output speech may be achieved with this implementation with a corresponding cost in increased memory size. For this memory design, a digital-to-analog converter (DAC) may be used to convert the digital representation of each sound unit into its analog representation.

The speech representations may also be stored in a compressed format. These and other variations for storing the corpus of sound units are within the scope of the invention.

The text-to-speech conversion system described herein may be advantageously used for various applications such as cellular phones, automobile communications, GPS/navigation systems, portable products, consumer electronics, and so on.

To reduce size, decrease cost, and minimize power consumption, the text-to-speech conversion system described herein may be implemented within a single integrated circuit to provide a single-chip solution. This integrated circuit is typically enclosed within a single package, such as a quad flat pack (QFP), a small outline package (SOP), an SOIC, a PLCC, a thin small outline package (TSOP), or some other package commonly used for integrated circuits. The integrated circuit may include one or multiple circuit dies, and this is within the scope of the invention.

The single-chip text-to-speech conversion system may be implemented in various integrated circuit technologies such as C-MOS, bipolar, Bi-CMOS, and so on.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A text-to-speech conversion system comprising:

a first module operative to convert text into words;

a second module operative to convert words into phonemes;

a third module operative to map phonemes into sound units; and a storage unit operative to store analog speech representations for a library of sound units, and wherein the first, second, and third modules and the storage unit are implemented within a single integrated circuit.

2. The system of claim 1, further comprising:

a control module operative to direct operations of the first, second, and third modules.

3. The system of claim 1, further comprising:

a processor operative to execute codes for the first, second, and third modules.

4. The system of claim 3, further comprising:

a non-volatile storage unit configured to store the codes for the first, second, and third modules.

5. The system of claim 3, further comprising:

a volatile storage unit configured to store the text to be converted to speech.

6. The system of claim 1, wherein the storage unit is a multi-level, non-volatile analog storage array.

7. The system of claim 1, wherein the storage unit is configured to store the analog speech representations for naturally spoken word parts that are stored as the library of sound units.

8. The system of claim 1, wherein the storage unit is configured to store a library of analog speech representations for the library of sound units for a selected language.

9. The system of claim 8, wherein the library includes at least one million analog speech representations.

10. The system of claim 8, further comprising:

a programming module operable to direct programming of a new library of analog speech representations for a new language into the storage unit.

11. The system of claim 8, wherein each sound unit corresponds to a valid analog speech representation stored in the storage unit.

12. The system of claim 1, further comprising:

a plurality of queues, one queue for each of the first, second, and third modules, wherein each queue is configured to store outputs from the associated module.

13. The system of claim 1, wherein the third module is operative to provide, for each sound unit, an address indicative of a location in the storage unit and the duration for a corresponding analog speech representation.

14. The system of claim 1, further comprising:

an input data buffer operative to store the text to be converted to speech; and a command buffer operative to store commands to be processed by the system.

15. The system of claim 1, further comprising:

an interface unit operative to provide a serial interface between the system and external units.

16. The system of claim 1, further comprising:

a coder/decoder operative to convert an analog output of the storage unit into a digital format.

17. The system of claim 1, wherein the text is provided in an ASCII format.

18. An integrated circuit comprising:

a volatile storage unit configured to store text;

a non-volatile storage unit configured to store codes for a plurality of modules used to convert the text to speech;

a processor operative to execute the codes for the plurality of modules; and a storage unit operative to store a library of analog speech representations, each analog speech representation being stored in an uncompressed analog format.

19. The integrated circuit of claim 18, wherein the plurality of modules include a first module operative to convert the text into words, a second module operative to convert the words into phonemes, and a third module operative to map the phonemes into analog speech representations.

20. The integrated circuit of claim 18, further comprising:

a serial interface unit operative to provide an interface between the integrated circuit and external units.

21. The integrated circuit of claim 18, further comprising:

a programming control unit operable to direct programming of a new library of analog speech representations into the storage unit.

22. The integrated circuit of claim 18, wherein the storage unit is a multi-level, non-volatile analog storage array.

23. An integrated circuit comprising:

means for storing text;

means for storing codes for a plurality of modules used to convert the text to speech;

means for executing the codes for the plurality of modules; and means for storing a library of analog speech representations, each analog speech representation being stored in an uncompressed analog format.

24. The integrated circuit of claim 23, wherein the plurality of modules include a first module operative to convert the text into words, a second module operative to convert the words into phonemes, and a third module operative to map the phonemes into analog speech representations.

* * * * *